US006910519B2

(12) United States Patent
Ludwig et al.

(10) Patent No.: US 6,910,519 B2
(45) Date of Patent: Jun. 28, 2005

(54) PROCESS AND APPARATUS FOR ASSEMBLY OF WAX TREES

(75) Inventors: Richard Ludwig, Farmington Hills, MI (US); Stephen Derby, Troy, NY (US); Raymond H. Puffer, Jr., Watervliet, NY (US); Bruce S. Phipps, Millbrook, NY (US)

(73) Assignee: MPI Incorporated, Poughkeepsie, NY (US)

( * ) Notice: Subject to any disclaimer, the term of this patent is extended or adjusted under 35 U.S.C. 154(b) by 0 days.

(21) Appl. No.: 10/304,840

(22) Filed: Nov. 26, 2002

(65) Prior Publication Data

US 2003/0098136 A1 May 29, 2003

Related U.S. Application Data

(60) Provisional application No. 60/333,526, filed on Nov. 28, 2001.

(51) Int. Cl.[7] ..... B22C 9/04; B22C 7/02

(52) U.S. Cl. ..... 164/34; 164/35; 164/516

(58) Field of Search ..... 164/34, 35, 516, 164/45

(56) References Cited

U.S. PATENT DOCUMENTS

| | | | | |
|---|---|---|---|---|
| 4,062,396 A | * | 12/1977 | Day | 164/15 |
| 4,651,799 A | * | 3/1987 | Chandley | 164/35 |
| 4,673,023 A | * | 6/1987 | Winston | 164/246 |
| 6,505,672 B2 | | 1/2003 | Mertins | 164/34 |

FOREIGN PATENT DOCUMENTS

JP 11244995 A 9/1999

OTHER PUBLICATIONS

V.A. Serov—Assembly Unit for Way Pattern Blocks 1987—2 pages.

Hitchiner's Foundry of the Future Foundry—Feb. 2000 John R. Wright—editor—4–pages.

Fred Ellin—Escast, Inc. Sarasota, Florida Automatic Pattern Casting Machine 33rd Annual Meeting of the Investment Cast. 1985.

Adept Technology Inc. Adept Smart Modules, Four pages, Nov. 18, 2002.

Advertisement—Fansteel Patented Automated Way Pattern Assembly Machine.

* cited by examiner

*Primary Examiner*—Len Tran

(74) *Attorney, Agent, or Firm*—Heslin Rothenberg Farley & Mesiti P.C.

(57) ABSTRACT

A process for the assembly of wax trees in which a wax runner is placed in a flat position and a wax pattern is located adjacent the wax runner. Both the wax runner pattern and the wax runner are heated and then are placed in contact with one another where heated. Then the wax pattern and the wax runner are separated slightly to form a fillet weld between the wax pattern and the wax runner. An apparatus is also provided which, by robotics, brings a multiplicity of wax patterns to a wax runner and which automatically heats both the wax patterns and the wax runner before simultaneously pressing both the wax pattern and the wax runner together. Once a wax tree assembly is completed a new wax runner replaces the wax runner that has been formed into a wax tree and additional wax runners are affixed in the same manner.

8 Claims, 8 Drawing Sheets

PROCESS AND APPARATUS FOR ASSEMBLY OF WAX TREES

RELATED APPLICATION

This application is based upon Provisional Application No. 60-333526 filed Nov. 28, 2001, and priority is claimed for this Application based upon the Provisional Application.

BACKGROUND OF THE INVENTION

1. Field of the Invention

This invention relates to the Lost Wax Process of casting and more specifically to a process and apparatus for the assembly of a wax tree.

2. Prior Art and Objects

The Lost Wax Process of casting is a widely used and well-know process. Basically, a wax pattern is formed by wax injection molding. Then, a multiplicity of the wax patterns, each of which includes a gate, is affixed to a runner creating a wax tree assembly. Then, ceramic is spread over the wax tree assembly. The resulting ceramic shell is then heated to melt the wax and the wax is thus removed from within the ceramic shell. Molten material, usually a metal, is then poured into the ceramic shell. Upon hardening, the ceramic is broken away and the desired castings are removed from the cast version of the runner.

The Lost Wax Process is a highly labor intensive procedure, but in more recent times, the wax pattern production, ceramic buildup and metal pouring have been successfully automated. The wax tree assembly, however, has remained a labor intensive operation. Furthermore, wax tree assembly requires artistic abilities on the part of the wax tree assembler. Even an experienced and artistic assembler cannot avoid improper connections which result in rejected castings.

It has been recognized that the most desirable fusion between the gate of the wax pattern and the wax runner is a fillet weld which is similar to the well-known fillet welds used in metal welding. However, despite the great need, the technique for readily achieving fillet weld fusion in wax tree assembly has not been previously known.

Various techniques have been proposed to automate the assembly of the wax tree assembly. One proposal, which apparently originated in Japan, places the gate of the wax patterns into a recessed surface of the wax runner and then molten wax is poured into the recessed area to fuse the wax pattern to the runner. The resulting fusion does not provide the desired fillet weld between the runner and the gate of the wax pattern and the poured wax does not possess the quality of the original molded wax of the runner. This method is also a manual operation and it does not appear to be an operation that offers a realistic basis for automation.

Wax Tree Assembly Machines have also been developed both in the United States and in Russia but both attach wax patterns to a runner that is held sideways. This results in potential dripping problems which can damage the wax pattern.

Therefore, it is an object of this invention to develop a process by which a highly acceptable bond between the gate of a wax pattern and a runner can be achieved.

It is a further object of this invention to provide an automated process for connecting the gate of a wax pattern to a runner.

It is a further object of this invention to provide a process for the assembly of wax trees that is economical and dependable.

It is further object of this invention to provide a process for the assembly of wax trees that produces a high rate of acceptable castings.

It is still another object of this invention to provide an apparatus to effectuate the successful operation of an automated process for the assembly of wax tree assemblies.

It is still another object of this invention to provide an apparatus that accurately and repeatedly produces a wax tree assembly.

It is a further object of this invention to provide an apparatus for the production of wax tree assemblies that is durable and dependable.

These and other objects and advantages of the present invention will become apparent to those of ordinary skill in the art as the description thereof proceeds.

SUMMARY OF THE INVENTION

A process for the assembly of wax trees is disclosed in which a wax runner is placed in a horizontal position. A wax pattern is placed in close proximity to the wax runner with the wax runner aligned with the wax pattern. Heat is applied to the wax pattern and to the wax runner. The wax runner and the wax pattern are placed into contact where the heat was applied and then the wax runner and the wax pattern are slightly separated from one another to form a fillet weld.

An apparatus is also provided for assembling a wax tree from a wax runner and a plurality of wax patterns. The apparatus includes a runner load station for holding a wax runner. A pattern loading table is located adjacent the runner load station for holding the wax patterns. A pattern assembly includes a pattern fixture for gripping the wax patterns which are located on the pattern loading table. The pattern assembly further includes a means for moving the wax patterns gripped by the pattern fixture to a location adjacent to the wax runner. A heating assembly is included with a heating device and means for heating the heating device to a temperature sufficient to melt wax. The heating assembly further includes means for moving the heating device between the wax runner and the wax patterns to melt surface wax on the wax runner and the wax patterns and to remove the heating device when wax melting has occurred. The pattern assembly still further includes means to bring the wax patterns and wax runner together where wax has been melted by the heating device.

DETAILED DESCRIPTION OF THE DRAWINGS

DETAILED DESCRIPTION OF THE NUMERALS

| NUMERAL | DESCRIPTION |
|---|---|
| 11 | Wax Pattern |
| 13 | Wax Runner |
| 15 | Fillet Weld |
| 16 | Wax Tree Assembly |
| 17 | Wax Pattern Gate |
| 18 | Pour Cup |
| 19 | Heated Blade |
| 21 | Base |
| 23 | Frame |
| 25 | Two Vertical Supports |
| 27 | One Horizontal Support |
| 29 | Pattern Loading Table |
| 31 | Centerline |
| 33 | Shaft |
| 37 | Runner Load Station |
| 41 | Wax Runner Holders |
| 43 | Holder Assembly |
| 44 | Pair of Upper Shafts |
| 45 | Rotation Motor |
| 47 | Lower Shaft |
| 49 | Lower Pulley Wheels |
| 51 | Upper Pulley Wheels |
| 53 | Pulley Belts |
| 55 | Pivot Axle |
| 56 | Rod |
| 57 | Pattern Assembly |
| 59 | Vertical Lifter Member |
| 61 | Horizontal Lifter Member |
| 63 | Horizontal Delivery Member |
| 65 | Lower End |
| 67 | Pattern Fixture |
| 69 | Pattern Trays |
| 71 | Outside Pattern Tray |
| 73 | Inside Pattern Tray |
| 75 | Heating Assembly |
| 76 | Heating Device |
| 79 | Lower horizontal Blade Member |
| 81 | Connector |
| 83 | Vertical Knife Member |
| 85 | Horizontal Heating Retraction Member |
| 87 | Horizontal Heating Member |
| 89 | Cleaning Station |
| 91 | Slot |
| 93 | Air jets |
| 95 | Controls |

DETAILED DESCRIPTION OF THE PREFERRED EMBODIMENT

Figure 1A:
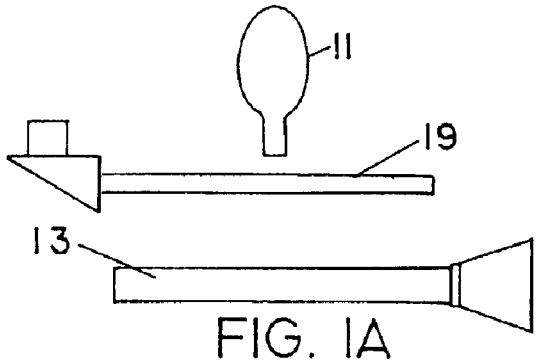
FIG. 1A through FIG. 1D show the steps which are used to affix a wax pattern to a wax runner to form a wax tree with the wax patterns and the wax runner joined by fusion in the form of a fillet weld.
Figure 1B:
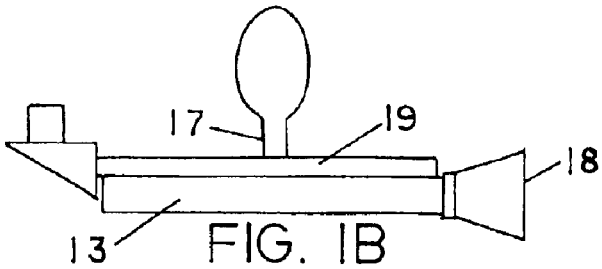
Figure 1C:
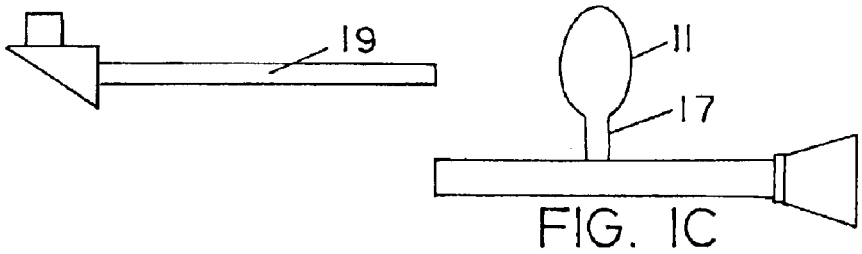
Figure 1D:
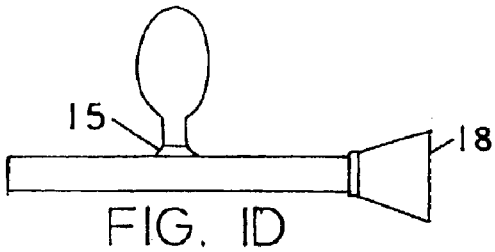
Figure 2:
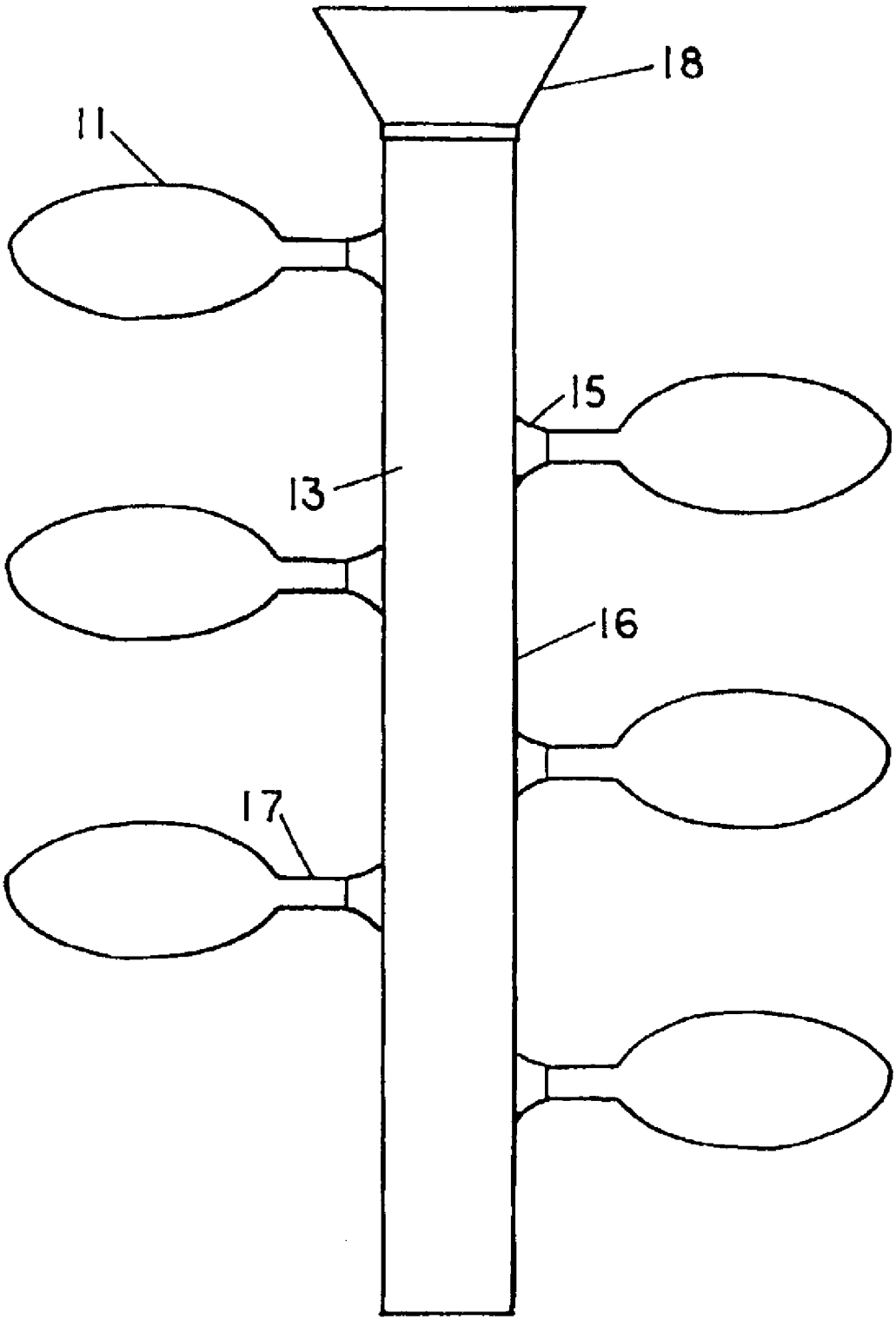
FIG. 2 is a pictorial view of a wax tree with the wax patterns affixed by a fusion in the form of a fillet weld.

Referring now to FIGS. 1A through 1D, the fundamental steps are shown, whether performed by a manual process of affixing just one wax pattern 11 at a time or performed by an automated process. In the attachment of a wax pattern 11 to a wax runner 13, the most desirable resultant form of fusion between the wax pattern 11 and the wax runner 13 is a fillet weld 15. Examples of a fillet weld 15 are shown in FIG. 1D and in FIG. 2. The fillet weld 15 is analogous to a fillet weld, as that term is used in the art of welding. In FIG. 2, the wax patterns 11 are shown affixed to the wax runner 13 forming a wax tree assembly 16. The fillet weld 15 is a rounded concave bead between the wax runner 13 and the wax pattern gate 17 of the wax pattern 11. The wax tree assembly 16 formed by the attachment of wax patterns 11 to the wax runner 13 is coated with ceramic. The wax runner 13 includes a pour cup 18. After the wax is removed from the ceramic mold and metal is cast in the ceramic mold, the rounded edge of the ceramic mold, which is the result of the fillet weld 15, vastly enhances the successful casting of the metallic part. The casting metal is poured through a pour cup, formed in the ceramic from the pour cup 18 of the wax runner 13. The fillet weld 15 also provides a strong bond between the wax pattern gate 17 of the wax pattern 11 and the wax runner 13.

Referring back to FIG. 1A, the wax pattern 11 and the wax pattern gate 17 are aligned so that the wax pattern gate 17 of the wax pattern 11 will be properly aligned with the surface of the wax runner 13. Before any fusion can occur, some bonding procedure must be used that is capable of bonding between the wax pattern gate 17 of the wax pattern 11 and the wax runner 13. Sticky wax can be applied to the wax pattern gate 17 and to the wax runner 13. A torch or heat gun may be used to heat the end of the wax pattern gate 17 and the surface of the wax runner 13. The preferred technique is to use a heated blade 19. The heated blade 19 may range from a simple putty knife heated on a Bunsen Burner to an electrically heated copper bar. The heated blade 19 may be brought into direct contact with the gate 17 and the wax runner 13 or it may be brought adjacent to the gate 17 and the wax runner 13 without actual contact. In the latter situation, a higher temperature for the heated blade 19 and a longer time is needed to provide the necessary melting without direct contact, but the heated blade 19 does not require cleaning when there is no contact. However, of all the possible means to heat the wax pattern gate 17 and the wax runner 13, the use of a heated blade 19 in direct contact is preferred.

As seen in FIG. 1B, the gate 17 and the wax runner 13 are both placed in direct contact with the heated blade 19. Then, as shown in FIG. 1C, the gate 17 of the wax pattern 11 and the wax runner 13 are brought together to create fusion after the heated blade 19 has been withdrawn. Once fusion is achieved and while the wax is still molten, the wax pattern gate 17 and the wax runner 13 are ever so slightly separated to form the desired fillet weld 15. Then, the wax is permitted to harden with the fillet weld 15 undisturbed.

The ever so slight separation in more definitive terms is approximately within a general range of ten one thousandths of an inch to sixty one thousandths of an inch depending upon the size of the wax pattern 11. This ever so slight withdrawal that produces a fillet weld 15 adds to the existing manual techniques and automation of the assembly of wax trees, as subsequently described herein, a technique for producing a superior bonding between wax patterns 11 and wax runners 13. It is also a process that is adaptable for use in an automated process performed by an automated apparatus.

Figure 3:
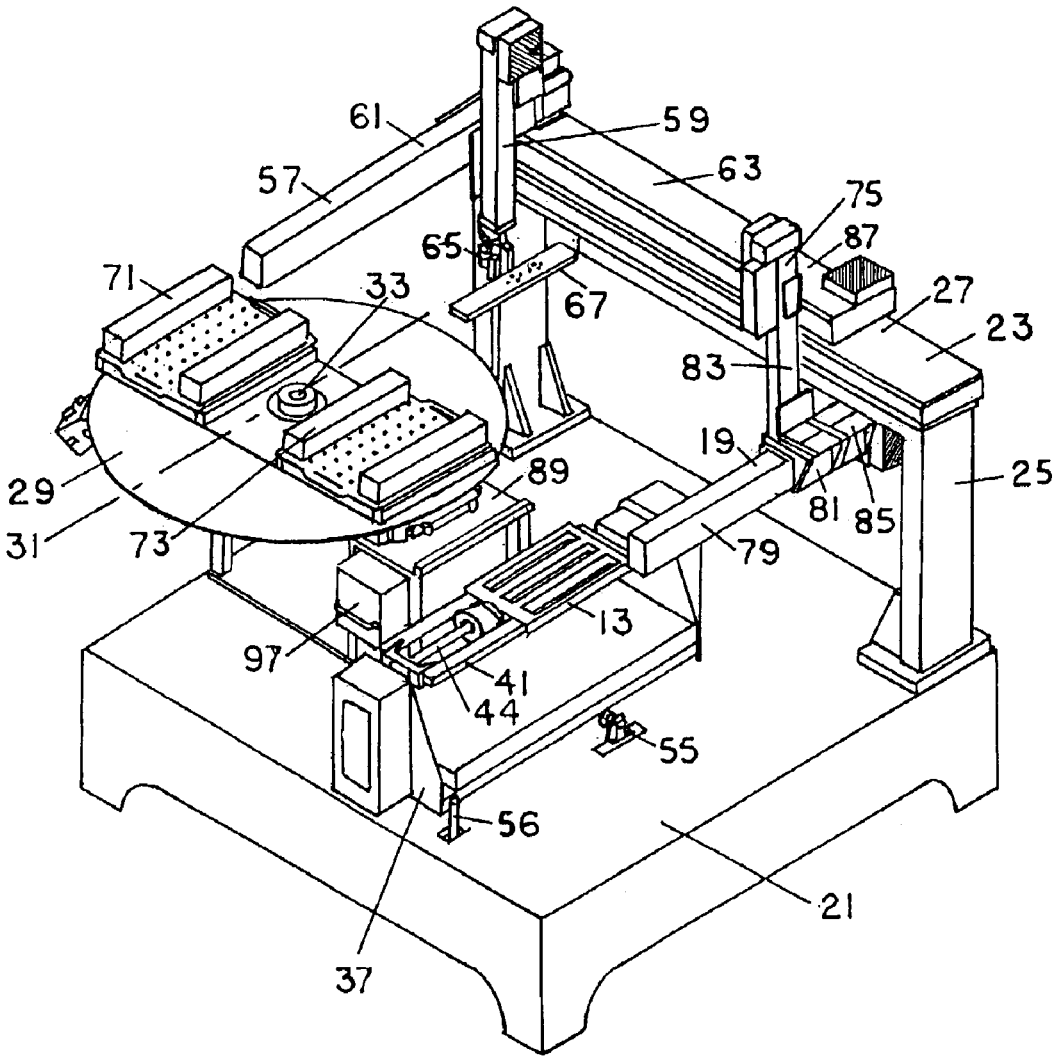
FIG. 3 is a pictorial view of an apparatus to affix automatically multiple wax patterns to a wax runner.
Figure 4:
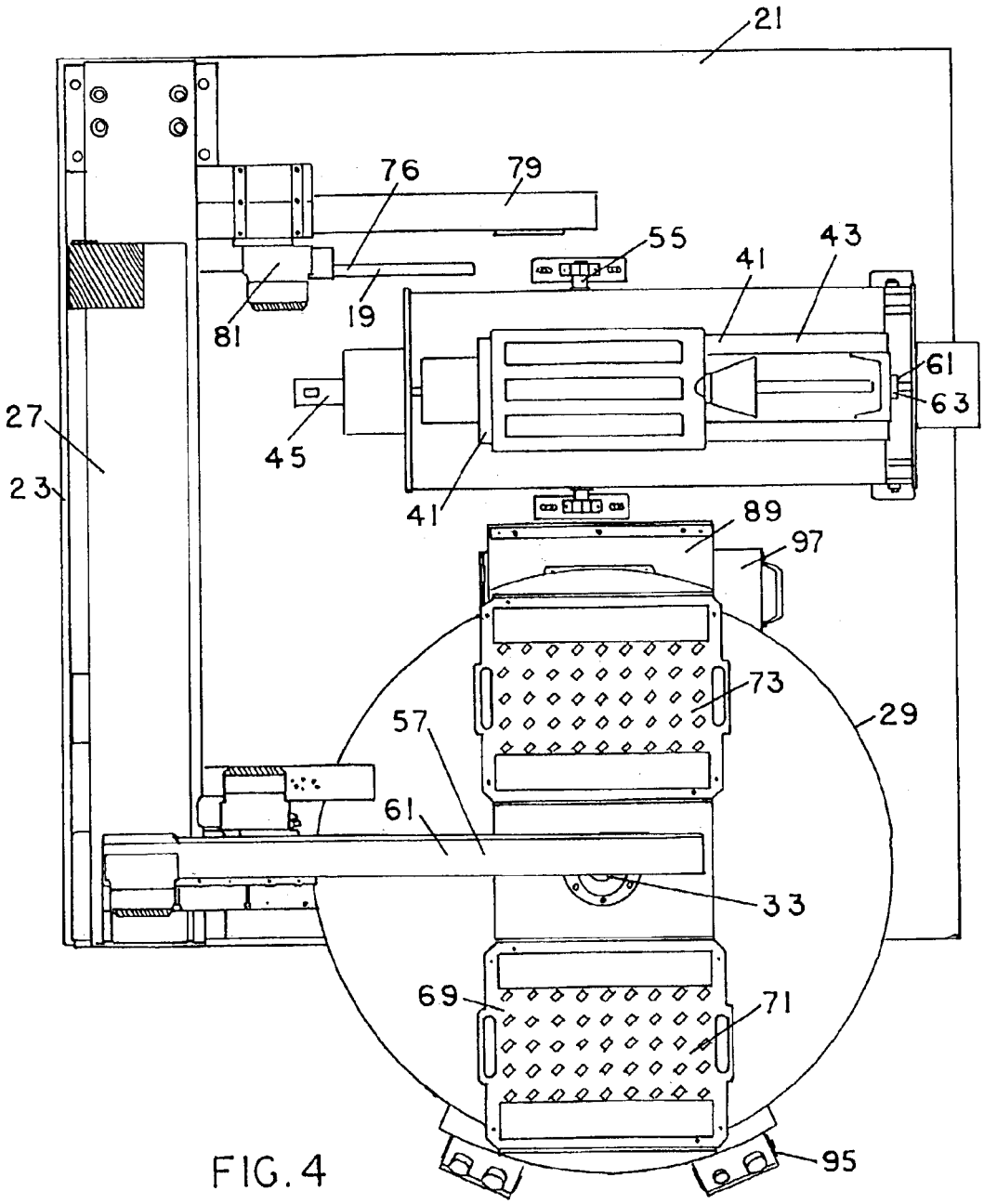
FIG. 4 is a top plan view of the same apparatus shown in FIG. 3.

Referring now to FIG. 3 and FIG. 4, an apparatus is shown for performing the process and for automatically performing the process. The apparatus is mounted upon a base 21. A frame 23, including two vertical supports 25 and one horizontal support 27, is located to one side of the base 21.

As best seen in FIG. 4 a pattern loading table 29, which is rotatable, is shown. Wax patterns 11 are placed on the pattern loading table 29 just outside the centerline 31 of the pattern loading table 29. The pattern loading table 29 rotates to place the wax patterns 11 just inside the centerline 31. The pattern loading table 29, which is circular, rotates about a shaft 33 mounted at the center point of the table 29 (FIGS. 3 and 5).

A runner load station 37 is mounted to rotate about the centerline of a wax runner 13. The wax is held by a pair of wax runner holders 41 which form a holder assembly 43. (FIGS. 4 and 5) A rotation motor 45, when actuated, rotates the holder assembly 43 within the runner load station 37. Since the wax runners 13 are made of wax, they do not have substantial strength. Therefore, at the bottom of the runner load station 37 there is a lower shaft 47. On the opposite ends of the lower shaft 47 are a pair of lower pulley wheels 49. Upper pulley wheels 51 are mounted on the pair of upper shafts 44. Each of the upper pulley wheels 51 are vertically aligned with one of the lower pulley wheels 49 and each of the aligned upper pulley wheels 51 and lower pulley wheels are connected by a pulley belt 53. At the end of the upper shaft 44 toward the frame 29, the rotation motor 45 is mounted which drives the upper shaft 44. In this way, the upper shaft 44, not connected directly to the rotation motor 45, is driven through the lower shaft 47 and the pulley belts 53. As a result, wax runner holders 41 are both simultaneously driven by the rotation motor 45 to assure that no twisting or other stress occurs in the wax runner 13.

The pair of wax runner holders 41 are located generally in line with the pattern loading table 29. In FIGS. 3 and 4, the wax runner 13 is shown being held by the pair of wax runner holders 41. As seen in FIGS. 4 and 5, the runner load station 37 is mounted on a pivot axle 55. This permits the runner load station 37 to tilt substantially at a right angle to the upper shafts 44 and to the lower shaft 47. A rod 56 is provided to tilt the runner load station 37 on the pivot axle 55. Wax runners, on occasion, are tapered and it is essential that the surface of the wax runner 13 be level. By tilting the runner load station 37, the surface of the wax runner 13 held within the pair of wax runner holders 41 is placed in a level position.

Figure 5:
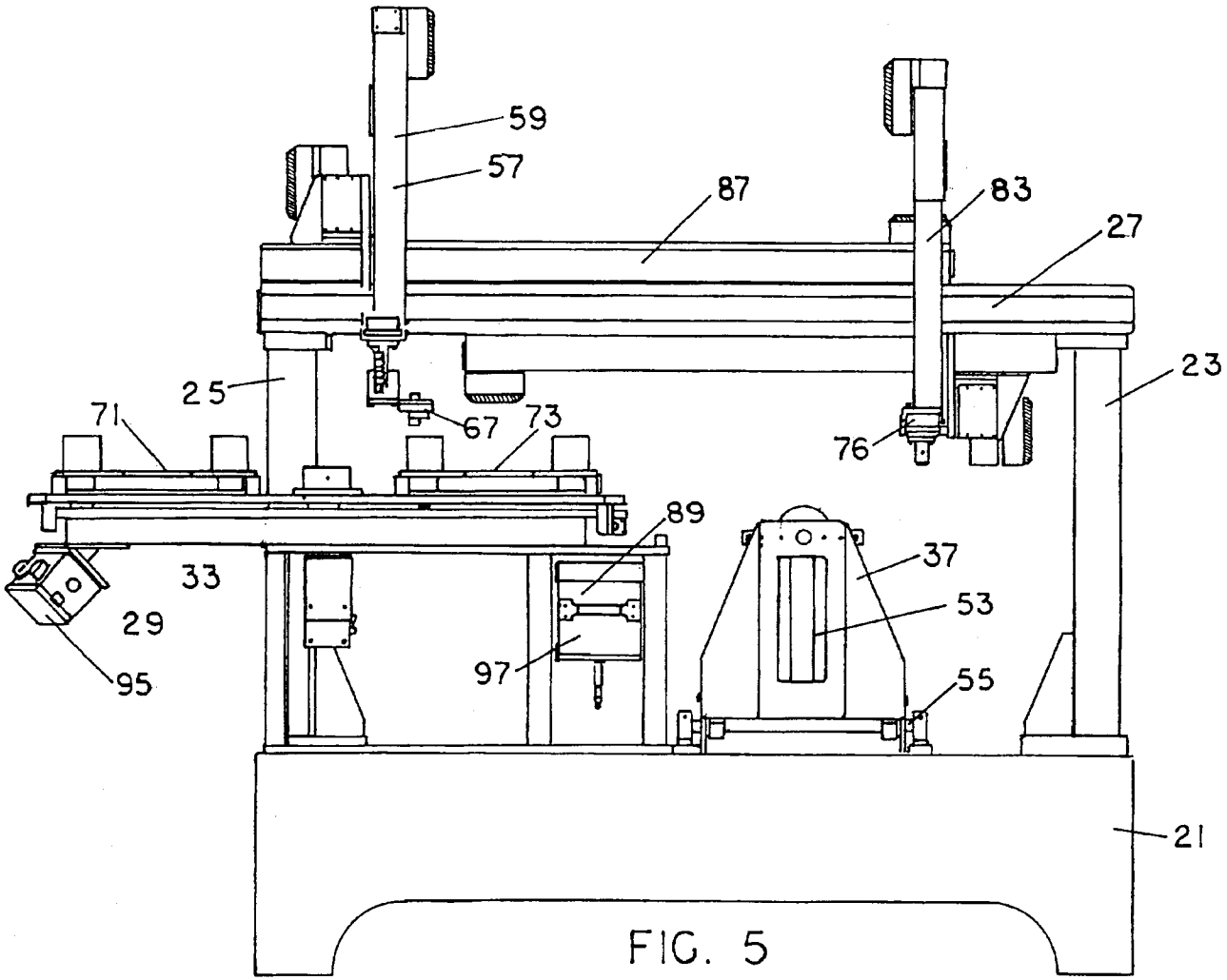
FIG. 5 is a side view of the same apparatus shown in FIG. 3.
Figure 6:
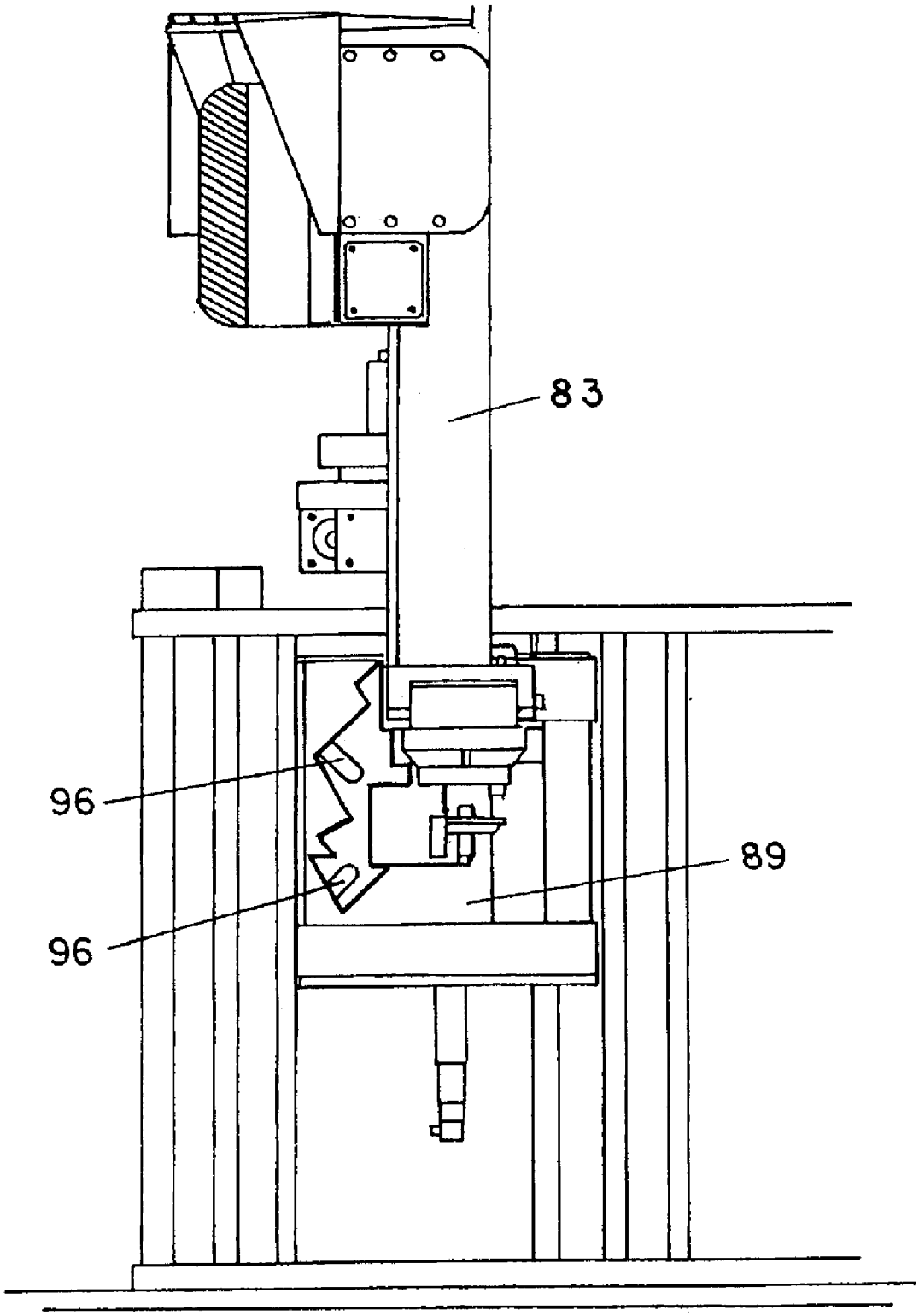
FIG. 6 is a side view of only the cleaning station and a part of the heating assembly from the opposite side shown in FIG. 5.
Figure 6A:
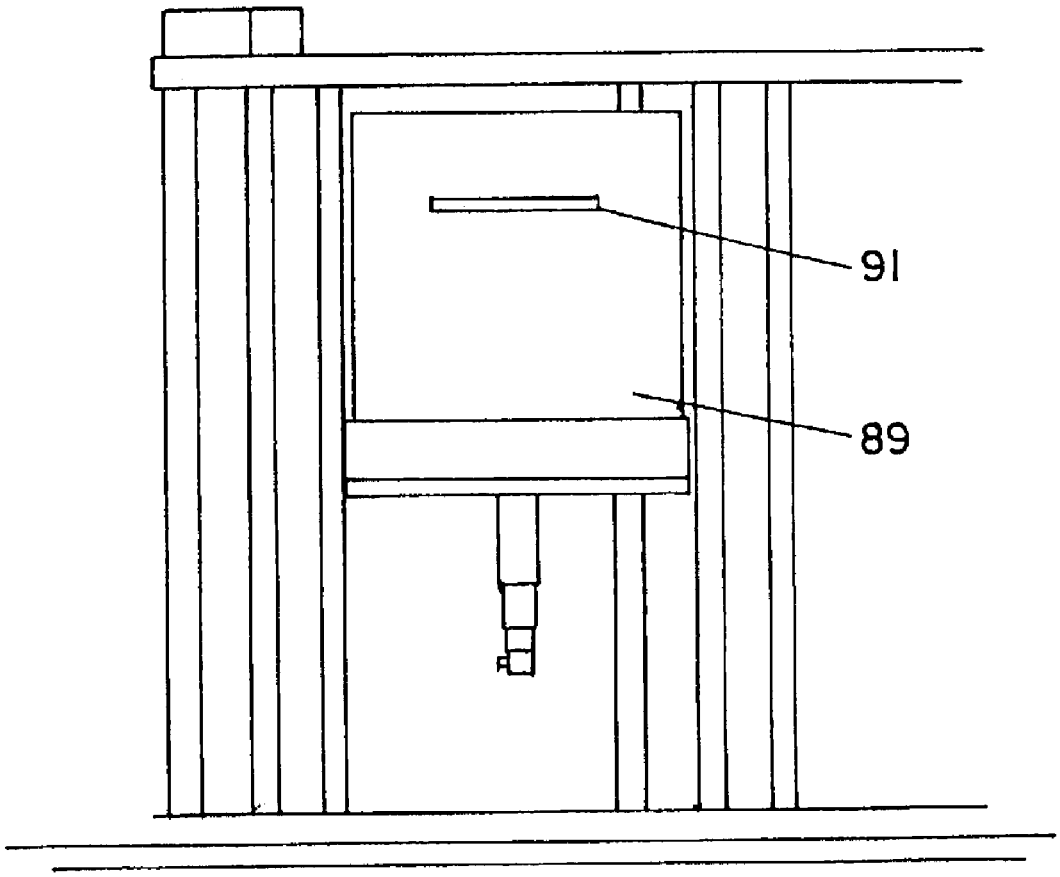
FIG. 6A is a side view of only the cleaning station as shown in FIG. 6 but with the Heating Assembly removed to show the slot in the cleaning station.
Figure 7:
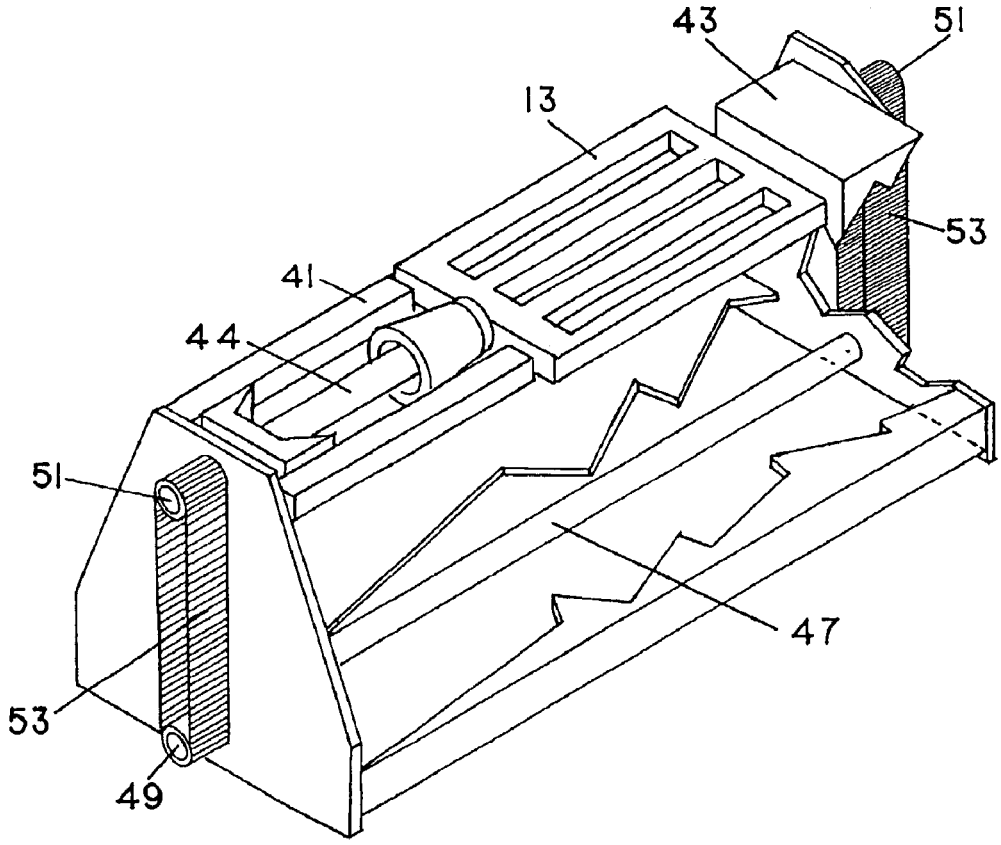
FIG. 7 is pictorial view of the runner load station partially broken away with the covers removed to show the upper shafts and the lower shaft and the pulley wheels and the pulley belts.

As best seen in FIG. 3, but which is also shown in FIGS. 4 and 5, a pattern assembly 57 is mounted on the base 21 to be accessible to the pattern loading table 29. The pattern assembly 57 includes a vertical lifter member 59, a horizontal lifter member 61 and a horizontal delivery member 63 all of which are supported by the frame 23. The pattern assembly 57 is a three-dimensional device.

The vertical lifter member 59 moves up and down essentially in a position perpendicular to the base 21. The horizontal lifter member 61 moves the vertical lifter member 59 across the base 21 from the pattern loading table 29 toward the frame 23. The horizontal delivery member 63 moves the vertical lifter member 59 from the pattern loading table 29 to the runner load station 37 and, more specifically, the horizontal lifter member 61 and the horizontal delivery member 63 place the vertical lifter member 59 directly over the wax runner 13 held by the wax runner holders 41 within the runner load station 37.

The vertical lifter member 59 has a lower end 65 closest to the base 21. Mounted on the lower end 65 of the vertical lifter member 59 is a pattern fixture 67. The pattern fixture 67 grasps the wax patterns 11 opposite the point where the wax patterns 11 are attached to the wax runner 13. Within the pattern fixture 67 are a plurality of pattern holders (not shown). Frequently, each wax pattern 11 requires a pattern holder that is specific to that specific wax pattern 11. In certain cases, a pattern holder may be adaptable to a limited variety of similar wax patterns 11 but wax patterns 11 must be carefully held without any possible deformation of the wax pattern 11. The series of pattern holders in the pattern fixture 67 holds a plurality of wax patterns 11 in a linearly spaced relationship. Pattern holders of various types and sizes are known and are available. A pattern fixture 67 is, in essence, a specialized clamp that positively holds the wax pattern 11 without deforming it.

The pattern loading table 29 has mounted upon it a pair of pattern trays 69. The pattern trays 69 are located on opposite sides of the shaft 33 on which the pattern loading table 29 rotates. The pattern trays 69 are substantially parallel to one another and equidistant from the shaft 33. Thus, when the pattern loading table 29 is rotated one hundred eighty degrees, the pattern tray 69 originally closest to the runner load station 37 is moved away form the runner load station 37 and the pattern tray 69, previously remote to the runner load station 37, is moved closest to the runner load station 37. Whichever of the pattern trays 69 is most remote from the runner load station 37 is the outside pattern tray 71, while the pattern tray 69 closest to the runner load station 37 is the inside pattern tray 73.

Each pattern tray 69 retains a plurality of wax patterns 11 in a spaced relationship consistent with the spaced relationship of the pattern holders when held by the pattern fixture 67 which is the desired spaced relationship for the wax patterns 11 when mounted on the wax runner 13. As a result, the attachment of wax patterns 11 to the wax runner 13 is extremely precise, resulting in a wax tree assembly 16 that is far superior to a wax tree that possibly could be achieved by a manual process.

A heating assembly 75 is also mounted on the frame 23 where the pattern assembly 57 is located. The heating assembly 75, when not use to melt surface wax on the wax runner 13 and the wax pattern 11, but during operation, is located above and to one side of the runner load station 37 opposite from the pattern loading table 29. The heating assembly 75, as shown in FIGS. 3, 4 and 5, includes a heating device 76 which is shown as a heated blade 19. The heated blade 19 is preferably electrically heated. The heated blade 19 is connected to a lower horizontal blade member 79 by a connector 81 which permits rapid removal and replacement. Other means may also be utilized for the heating device 76. The heating assembly 75 further includes a vertical knife member 83 which both raises the heating device 76 upward away from the runner load station 37 and lowers the heating device 76 toward the runner load station 37. A horizontal heating retraction member 85 moves the heating device 76 to and from the runner load station 37 and the frame 23. A horizontal heating member 87 moves the heating device 76 across the runner load station 37 toward the pattern loading table 29 and back to the side of runner load station 37 opposite the pattern loading table 29. Like the pattern assembly 57, the heating assembly 75 is a three-dimensional device.

Located beneath the pattern loading table 29 is a cleaning station 89. Any gas could be used, but most likely air would be used in the cleaning station 89. The term "air" as used herein, including the claims, means any gas stream.

When the heated blade 19 is used in direct contact with the wax pattern 11 and the wax runner 13 to produce wax melting, wax deposits form on the heated blade 19. Excessive deposits of wax on the heated blade 19 result in lost quality of the wax tree assembly unless the heated blade 19 is cleaned on a regular schedule. The preferred schedule is to clean the heated blade 19 after each wax tree assembly 16 is completed. A slot 91 is provided in the cleaning station 89 at the end closest to the frame 23. After each wax tree assembly 16 is complete, the heated blade 19 is inserted into the slot 91 by the vertical knife member 83, the horizontal heating retraction member 85 and the horizontal heat member 87. Inside the cleaning station 89 are a plurality of air jets 93 which blast air against the heated blade 19 and force the accumulated wax from the heated blade. Whenever the heated blade 19 is not operating, it is stored in the slot 91 in the cleaning station to prevent the heated blade being inadvertently touched by an operator.

The multi-directional equipment used in the pattern assembly 57 and in the heating assembly 75, as well as the controls 95 for the pattern loading table 29 and runner load station 37, are available commercially.[1] Accordingly, a detailed explanation of these devices is not included herein.

[1]. Automated multi-directional devices can be customized from products produced by Adept Technology, Inc., 3011 Tread Drive, Livermore, Calif.

As best seen in FIGS. 3 and 5, wax patterns 11 are placed in the outside pattern tray 71 on the pattern loading table 29. The pattern loading table 29 is outside the centerline 31. The pattern loading table 29 is rotated a half revolution, one hundred eighty degrees. This changes the outside pattern tray 71 into being the inside pattern tray 73. The outside pattern tray 71 may be automatically loaded from the equipment producing the wax patterns 11 or the outside pattern tray 71 may be loaded manually. The controls 95 for use by an operator are located adjacent the outside pattern tray 71 which is the location for the operator.

As still shown in FIGS. 3 and 5, the pattern fixture 67 on the vertical lifter member 59 picks up wax patterns 11 from the inside pattern tray 73. The vertical lifter member 59 raises the wax patterns 11 held by the pattern fixture 67. The horizontal lifter member 61 and the horizontal delivery member 63 move the pattern fixture 67 to the desired location over the wax runner 13 held by the wax runner holders 41. The wax runner 39 must first be placed in the runner load station 37 and the wax runner 13 must be held by the pair of wax runner holders 41 which must hold the wax runner 13 level using the pivot axle 55.

The vertical lifter member 59 is lowered within close proximity to the wax runner 11. The heating assembly 75 moves the heated blade 19 into contact with the wax pattern 11 and the wax runner 13 to melt surface wax on both the wax pattern 11 and the wax runner 13. The heated blade 19 is withdrawn by the heating assembly 75. The wax patterns 11 are lowered by the vertical lifter member 59 so that the heated portions of the wax runner 13 and the wax patterns 11 are in contact. The vertical lifter member 59 then moves slightly upward to withdraw the wax patterns 11 from the wax runner 13 just sufficiently to form a fillet weld 15 between the wax runner 13 and the wax patterns 11.

Once a wax runner 13 has had a full compliment of wax patterns 11 attached to it, the wax runner 13 is replaced with another wax runner 13 in the runner load station 37. When only one side of a wax runner 13 has been completed, the wax runner 13 is turned over by the rotation of the pair of runner holders 41 as previously described. Also, the heated blade 19 is inserted into the slot 91 in the cleaning station 89 for cleaning afters each wax runner 13 has been completed on both sides.

The apparatus shown in FIGS. 3 and 4 performs a repeatable process with predictable, high quality results. The cost of the automated operation is reduced and permits connecting the apparatus to an automatic wax pattern production apparatus (not shown) for continuous uninterrupted production of wax tree assemblies 16.

The use of the automated apparatus shown in FIGS. 3, 4 and 5 produces highly accurate spacing of the wax patterns 11 and forms the desired fillet welds 15.

It is to be understood that the drawings and description matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What is claimed is:

1. A process for the assembly of wax trees, such process comprising:

providing a wax runner and a wax pattern;

heating the wax pattern and the wax runner;

placing the wax pattern and the wax runner together where the wax pattern and the wax runner were heated; and slightly separating the wax pattern from the wax runner to form a fillet weld between the wax pattern and the wax runner, wherein the placing and the slightly separating are performed by an automated apparatus.

2. A process for the assembly of wax trees according to claim 1 wherein the wax runner is placed in a flat position and the wax pattern is situated generally at right angles to the wax runner.

3. A process for the assembly of wax trees according to claim 1 wherein the wax pattern and the wax runner are heated by a heated blade.

4. A process for the assembly of wax trees, such process comprising:

placing a wax runner in a flat position;

placing multiple wax patterns in close proximity to the wax runner with the multiple wax patterns aligned with the wax runner;

heating the multiple wax patterns and the wax runner;

placing the multiple wax patterns and the wax runner together where the wax pattern and the wax runner were heated; and slightly separating the multiple wax patterns from the wax runner to form a fillet weld between each wax pattern and the wax runner.

5. A process according to claim 4 wherein the multiple wax patterns and the wax runner are heated by a heated blade.

6. A process according to claim 4 wherein the multiple wax patterns and the wax runner are placed together by lowering the multiple wax patterns to the wax runner.

7. A process according to claim 4 wherein the wax patterns are slightly separated from the wax runner by slightly raising the wax patterns from the wax runner.

8. The process for the assembly of wax trees according to claim 3 wherein the process further comprises cleaning the heated blade.

* * * * *